US007416414B2

(12) United States Patent
Bozzone et al.

(10) Patent No.: US 7,416,414 B2
(45) Date of Patent: Aug. 26, 2008

(54) MAGNETIC MEMBER FOR PROVIDING ELECTRICAL CONTINUITY AND METHOD FOR ASSEMBLING SAME

(75) Inventors: Stephen O. Bozzone, Lauderhill, FL (US); Patrick Hampton, Deerfield Beach, FL (US); Evan J. Kassof, Coral Springs, FL (US); Alexander E. Taits, Boca Raton, FL (US); James L. Tracy, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/686,480

(22) Filed: Mar. 15, 2007

(65) Prior Publication Data

US 2008/0132090 A1 Jun. 5, 2008

Related U.S. Application Data

(60) Provisional application No. 60/868,009, filed on Nov. 30, 2006.

(51) Int. Cl.
*H01R 13/60* (2006.01)

(52) U.S. Cl. ..... 439/39

(58) Field of Classification Search ..... 439/39, 439/38, 40

See application file for complete search history.

(56) References Cited

U.S. PATENT DOCUMENTS 4,611,050 A 9/1986 Barta et al.
4,659,622 A 4/1987 Barta et al.
6,110,399 A 8/2000 McArdle et al.
6,129,559 A 10/2000 Hirata et al.
6,401,330 B2 6/2002 Baldwin
6,561,815 B1 5/2003 Schmidt
6,796,840 B2 * 9/2004 Harada ..... 439/620.05
7,074,045 B2 * 7/2006 Kawahigashi et al. ..... 439/38
7,341,458 B1 * 3/2008 Koh ..... 439/39
2002/0164892 A1 * 11/2002 Girbachi et al. ..... 439/38
2007/0207672 A1 * 9/2007 Takagi et al. ..... 439/607

OTHER PUBLICATIONS

Ferrite Magnets (product descriptions), http://www.shawmagnets.com/ferritemagnets.html, Accessed Jan. 29, 2007, 2 pgs.

U.S. Appl. No. 11/305,780, filed Dec. 16, 2005, Hernandez, et al., 19 pgs.

* cited by examiner

*Primary Examiner*—Gary F. Paumen

(57) ABSTRACT

A device that includes a circuit board (214) and a first electrical contact (100). The first electrical contact can include a jacket (104) and a magnetic member (102) that slideably engages the jacket. The jacket can be soldered, fastened or clamped to the circuit board, or conductively attached to the circuit board in any other suitable manner. A first portion of the jacket can be attached to the circuit board so as to provide electrical continuity between the jacket and a conductive portion of the circuit board. The magnetic member can include a flange (108, 208) and can be translationally moveable between a first position in which the flange does not engage the jacket and a second position in which the flange does engage the jacket.

20 Claims, 2 Drawing Sheets

FIG. 4
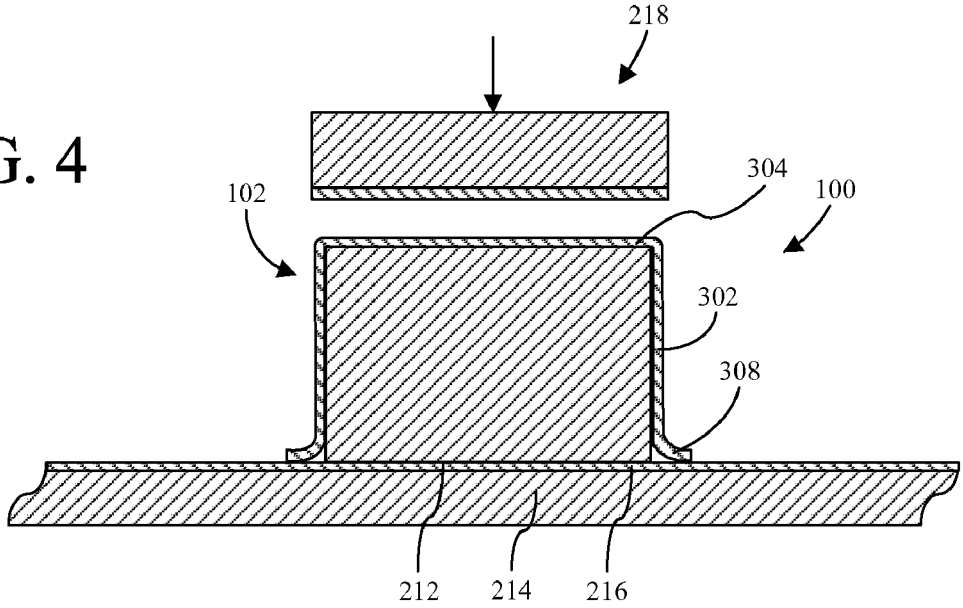
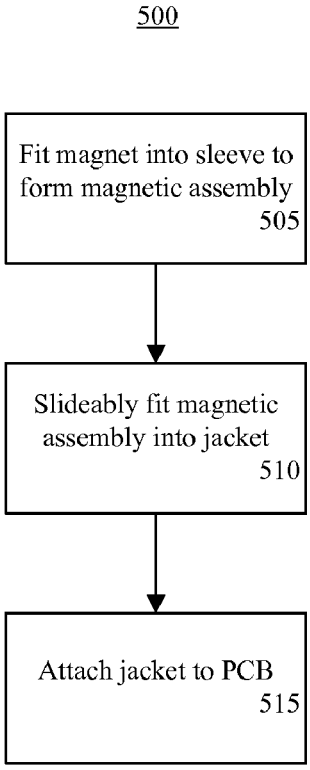
FIG. 5
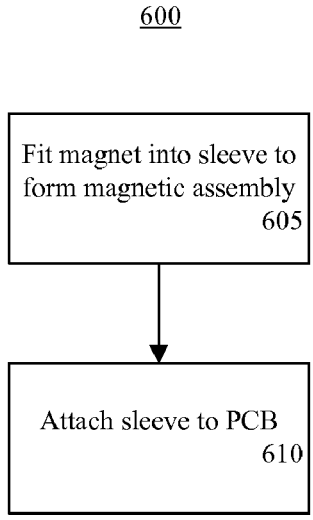
FIG. 6

MAGNETIC MEMBER FOR PROVIDING ELECTRICAL CONTINUITY AND METHOD FOR ASSEMBLING SAME

CROSS REFERENCES TO RELATED APPLICATIONS

This application claims benefit of U.S. provisional patent application Ser. No. 60/868,009, filed Nov. 30, 2006, which is herein incorporated by reference.

BACKGROUND OF THE INVENTION

1. Field of the Invention

The present invention generally relates to electrical contacts.

2. Background of the Invention

Oftentimes it is desirable to design an electronic device in a modular fashion in which the device comprises a plurality of sub-assemblies that are physically and electrically connected. For example, a first sub-assembly may include a first connector and a second sub-assembly may include a second connector that mates to the first connector when the sub-assemblies are physically attached to one another. In order to insure proper connection of mating connectors during assembly, it is often required for the positioning of such connectors to be held to very tight tolerances. Moreover, attachment of the sub-assemblies to one another must be performed very precisely. Such requirements add costs to the manufacture of the device.

SUMMARY OF THE INVENTION

The present invention relates to a device that includes a circuit board and a first electrical contact. The first electrical contact can include a jacket and a magnetic member that slideably engages the jacket. The jacket can be soldered, fastened or clamped to the circuit board. A first portion of the jacket can be attached to the circuit board so as to provide electrical continuity between the jacket and a conductive portion of the circuit board. The magnetic member can include a flange and can be translationally moveable between a first position in which the flange does not engage the jacket and a second position in which the flange does engage the jacket.

The magnetic member can include a magnet and an electrically conductive plating adhered to the magnet. In another arrangement, the magnetic member can include a magnet and an electrically conductive sleeve in which the magnet is positioned. The magnet can be statically positioned within the sleeve. For example, the magnet can engage the sleeve via an interference fit, magnetic attraction or an adhesive. The sleeve can include a flange and can be translationally moveable between a first position in which the flange does not engage the jacket and a second position in which the flange does engage the jacket.

The jacket can include at least one guide member with which the magnetic member is slideably engaged. In such an arrangement, the magnetic member can include a flange and can be translationally moveable between a first position in which the flange does not engage the guide member and a second position in which the flange does engage the guide member.

The device further can include a second electrical contact including at least a first portion that is ferromagnetic. The second electrical contact can engage the magnetic member so as to provide electrical continuity between the second electrical contact and the magnetic member. Further, the first portion of the second electrical contact can be magnetically attracted to the magnetic member.

The present invention also relates to a device that includes a circuit board and a first electrical contact. The first electrical contact can include a magnet and an electrically conductive sleeve in which the magnet is positioned. The magnet can be statically positioned within the sleeve. A first portion of the sleeve can be attached to the circuit board so as to provide electrical continuity between the sleeve and a conductive portion of the circuit board. For example, the sleeve can be soldered, fastened or clamped to the circuit board. The device also can include a second electrical contact. The second electrical contact can include at least a first portion that is ferromagnetic. The second electrical contact can engage the sleeve so as to provide electrical continuity between the second electrical contact and the sleeve. Further, the first portion of the second electrical contact can be magnetically attracted to the magnet.

The present invention also relates to a method of assembling the contact onto a circuit board. The method can include fitting a magnet into the sleeve to form the magnetic assembly, slideably fitting the sleeve into a jacket, and attaching the jacket to the circuit board. Fitting the magnet into the sleeve can include interference fitting the magnet within the sleeve or attaching the magnet to the sleeve with an adhesive. Attaching the jacket to the circuit board can include soldering the jacket to the circuit board or attaching the jacket to the circuit board with a clamp or fastener.

BRIEF DESCRIPTION OF THE DRAWINGS

Preferred embodiments of the present invention will be described below in more detail, with reference to the accompanying drawings, in which:

FIG. 4 depicts an enlarged cross-section view of another arrangement of the electro-mechanical contact of FIG. 1, taken along section line 2-2;

FIG. 5 is a flowchart that is useful for understanding the present invention; and FIG. 6 is another flowchart that is useful for understanding the present invention.

DETAILED DESCRIPTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

Figure 1:
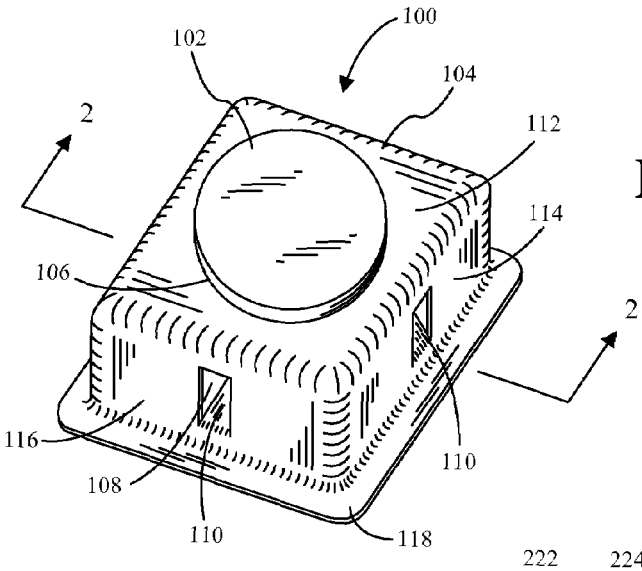
FIG. 1 depicts a perspective view of an electro-mechanical contact that is useful for understanding the present invention.

FIG. 1 depicts a perspective view of an electro-mechanical contact (hereinafter "contact") 100 that is useful for understanding the present invention. The contact 100 can be both magnetic and electrically conductive. Thus, the contact 100 can magnetically attract an object while simultaneously providing electrical continuity to the object. Use of the contact 100 in an electronic device can eliminate the need to carefully align mating connectors of the prior art and reduce reliance on mechanical fasteners, thereby simplify the device's manufacturing process. Moreover, the contact 100 can be implemented without the use of a spring, which over time may lose its resilience and degrade in performance.

The contact 100 can comprise an electrically conductive magnetic member 102 and an electrically conductive jacket 104. The magnetic member 102 can protrude through an aperture 106 and into a cavity 108 defined in the jacket 104. One or more guide members 110 can protrude into the cavity 108 and contact the magnetic member 102. The guide members 110 can maintain alignment of the magnetic member 102. In one arrangement, the guide members 110 can provide electrical conductivity between the magnetic member and the jacket 104, although it should be noted that non-conductive guide members can be used and the invention is not limited in this regard. In aspect of the invention, the guide members 110 can be punched from one or more surfaces 114, 116 of the jacket 104.

The magnetic member 102 can comprise a magnet. The magnet can comprise, for example, iron, hematite, magnetite or neodymium, or a combination of materials, such as neodymium, iron and boron. Still, wide varieties of other suitable magnetic materials are known in the art and the invention is not limited in this regard.

The jacket 104 can be formed from a material that is suitably rigid and suitably conductive, or can be formed from a plurality of materials that, when combined, provide suitable rigidity and conductivity. In one arrangement, the jacket 104 can be formed from a conductive metal, for example, aluminum, nickel, copper, silver, gold, etc. In another arrangement, the jacket 104 can be formed from an alloy, for example, steel, brass, nickel-silver, and so on. In yet another arrangement, the jacket 104 can be formed from a plurality of suitable materials, for example a substrate on which a veneer or plating is applied. For instance, the jacket 104 can be formed of plastic which has a layer of conductive plating. Still, a myriad of other materials can be used to form the jacket 104 and the invention is not limited in this regard.

In one arrangement, the jacket 104 can have generally square or rectangular surfaces 112, 114, 116. In another arrangement, the jacket 104 can have other geometries. For example, the jacket 104 can be formed to be generally cylindrical in shape. Moreover, the top side 112 can be generally round, triangular, pentagonal, hexagonal, etc.

The jacket 104 can include a flange 118. The flange can be used to attach the contact 100 to a device component, such as a circuit board. For example, the flange 118 can be soldered or clamped to the device component. In another arrangement, one or more apertures (not shown) can be defined in the flange 118 to facilitate use of fasteners to attach the contact 100 to the device component.

The jacket 104 can be formed in any suitable manner. For example, the jacket 104 can be molded, drawn, extruded, punched, or fabricated using any other suitable process. Moreover, plating, for example electro-tin plating or nickel plating, can be applied to the jacket 104.

Figure 2:
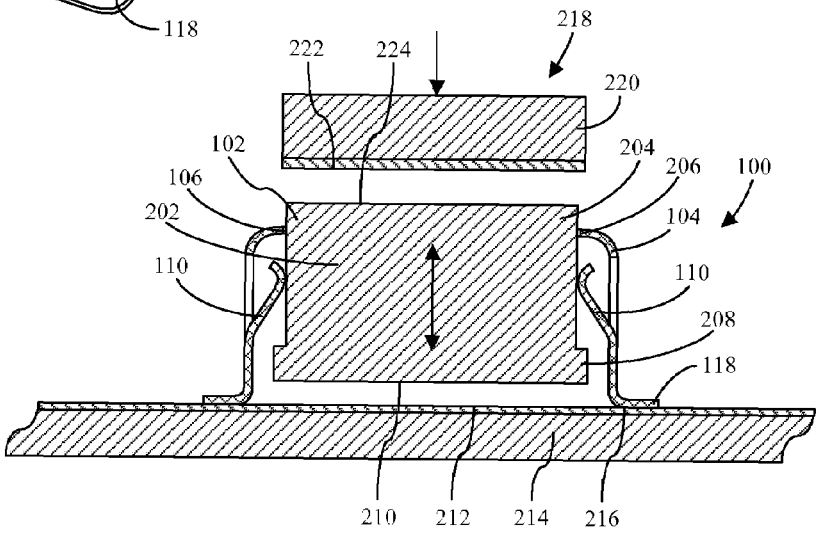
FIG. 2 depicts an enlarged cross-section view of the electro-mechanical contact of FIG. 1, taken along section line 2-2.

FIG. 2 depicts an enlarged cross-section view of the contact 100 of FIG. 1 taken along section line 2-2. As noted, the magnetic member 102 can comprise a magnet 202. A first portion 204 of the magnet 202 can be positioned within the aperture 106. In addition, the guide members 110 of the jacket 104 can engage the first portion 204 and can provide electrical conductivity between the jacket 104 and the magnetic member 102. The rim 206 of the aperture 106 and the guide members 110 can maintain alignment of the magnetic member 102.

The magnetic member 102 also can include a flange 208. The flange 208 can comprise a second portion of the magnetic member 102. The magnetic member 102 can move translationally between a first position in which a bottom 210 of the magnetic member 102 engages an object, such as an upper surface 212 of a circuit board 214, and a second position in which the flange 208 engages the guide members 110 of the jacket 104. In the first position, the flange 208 may not engage the guide members 110.

The magnetic member 102 can comprise a conductive material or an electrically conductive plating adhered to the magnet 202. Accordingly, the magnetic member 102 can be electrically continuous with the rim 206 of the aperture 106 and/or with the guide members 110.

The jacket 104 can be attached to the circuit board 214 to form an electrically continuous connection with at least one circuit trace 216 of the circuit board 214. For example, the flange 118 of the jacket 104 can engage the circuit trace 216 in a suitable manner. For instance, the flange 118 can be soldered to the circuit trace 216, attached to the circuit board 214 with a clamp or fastener, or held in electrical contact with the circuit trace 216 in any other suitable manner.

In operation, the magnetic member 102 can magnetically attract a second electrical contact (hereinafter "second contact") 218. For example, the magnetic member 102 can attract a portion 220 of the second contact 218, which may comprise a ferromagnetic material, such that an electrically conductive surface 222 of the second contact 218 engages an upper surface 224 of the magnetic member 102. Thus, an electrically continuous connection can be provided between the second contact 218, the magnetic member 102, the jacket 104 and the circuit trace 216.

Figure 3:
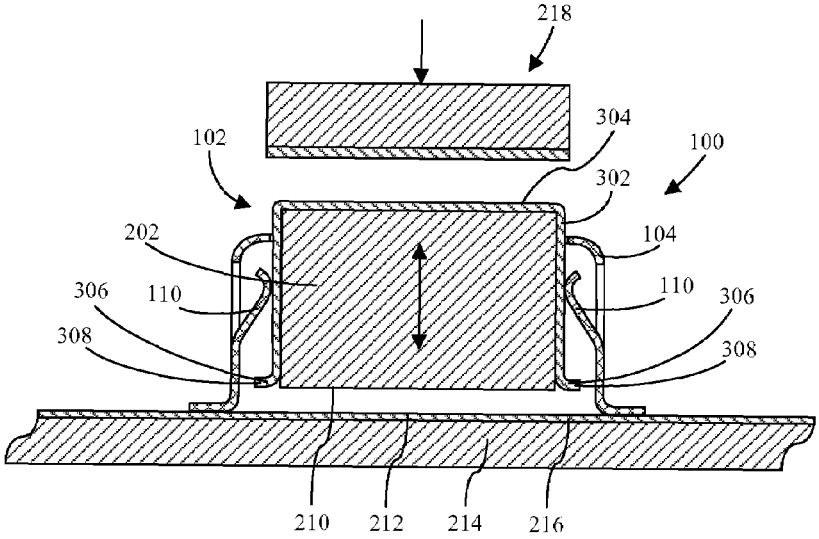
FIG. 3 depicts an enlarged cross-section view of another arrangement of the electro-mechanical contact of FIG. 1, taken along section line 2-2.

FIG. 3 depicts an enlarged cross-section view of another arrangement of the contact 100 of FIG. 1 taken along section line 2-2. In this arrangement, the magnet 202 can be positioned within a sleeve 302, which may be electrically conductive. For example, the sleeve 302 can be formed from a conductive metal or alloy, and/or have a conductive plating applied to its surface.

The sleeve 302 can be molded, drawn, extruded, punched, or fabricated using any other suitable process. In one arrangement, the shape of the sleeve 302 can be configured to receive the magnet 202. For example, if the magnet 202 has a cylindrical shape, the sleeve 302 can have a cylindrical shape. If the magnet 202 has a cubical shape, the sleeve 302 can be cubical in shape. Still, the sleeve and magnet can have any other shape and the invention is not so limited. Moreover, in another arrangement, the sleeve 302 can have a shape that is different from the shape of the magnet 202.

In one aspect of the inventive arrangements, the sleeve 302 can be provided with an upper portion 304. In another arrangement, the sleeve 302 can be generally tubular without the upper portion 304. A portion 306 of the sleeve 302 can be configured to form a flange 308. For example, an opening of the sleeve 302 can be flared. The magnet 202 can be statically positioned within the sleeve 302 using an interference fit, an adhesive, magnetic attraction or in any other suitable manner.

As used herein, the term "statically positioned" means that once assembled the magnet 202 and the sleeve 302 generally do not move relative to one another.

The magnetic assembly 102 can be positioned within the jacket 104 such that the guide members 110 engage the sleeve 302 so as to provide an electrically continuous connection. Further, the magnetic member 102 can move translationally between a first position in which a bottom 210 of the magnetic member 102 engages an object, such as the upper surface 212 of the circuit board 214, and a second position in which the flange 308 of the sleeve 302 engages the guide members 110 of the jacket 104. In one arrangement, while in the first position the flange 308 does not engage the guide members 110, although the guide members 110 may still contact other portions of the sleeve 302. As noted, in operation the magnetic member 102 can magnetically attract the second contact 218. Thus, an electrically continuous connection can be provided between the second contact 218, the sleeve 302 of the magnetic member 102, the jacket 104 and the circuit trace 216.

FIG. 4 depicts an enlarged cross-section view of another arrangement of the contact 100 of FIG. 1 taken along section line 2-2. In this arrangement, the jacket is not provided. Instead, the sleeve 302 of the magnetic member 102 can extend to, and engage, the upper surface 212 of the circuit board 214. For example, the flange 308 of the sleeve 302 can be statically positioned to engage the circuit trace 216 in a suitable manner. For instance, the flange 308 can be soldered to the circuit trace 216, attached to the circuit board 214 with a clamp or fastener, or held in electrical contact with the circuit trace 216 in any other suitable manner. As noted, the sleeve 302 can be configured to include or not include the upper portion 304. In operation, the magnetic member 102 can magnetically attract the second contact 218. Thus, an electrically continuous connection can be provided between the second contact 218, the sleeve 302, and the circuit trace 216.

FIG. 5 is a flowchart that is useful for understanding a method 500 of assembling the contact onto a circuit board. At step 505, the magnet can be fitted into the sleeve to form the magnetic assembly. For example, the magnet can be interference fitted into the sleeve, held within the sleeve via magnetic attraction, or attached to the sleeve with an adhesive. At step 510, the magnetic assembly can be slideably fitted into the jacket. At step 515, the jacket can be attached to the circuit board. For example, the jacket can be soldered to the circuit board or attached with a clamp or fastener.

FIG. 6 is another flowchart that is useful for understanding a method 600 of assembling the contact onto a circuit board. At step 605, the magnet can be fitted into the sleeve to form the magnetic assembly. At step 610, the sleeve can be attached to the circuit board. As noted, the sleeve can be soldered to the circuit board or attached with a clamp or fastener.

This invention can be embodied in other forms without departing from the spirit or essential attributes thereof. Accordingly, reference should be made to the following claims, rather than to the foregoing specification, as indicating the scope of the invention.

What is claimed is:

1. A device, comprising:
a circuit board; and
a first electrical contact comprising:
a jacket; and
a magnetic member that slideably engages the jacket;
wherein a first portion of the jacket is attached to the circuit board so as to provide electrical continuity between the jacket and a conductive portion of the circuit board.

2. The device of claim 1, wherein:
the magnetic member comprises a flange; and
the magnetic member is translationally moveable between a first position in which the flange does not engage the jacket and a second position in which the flange does engage the jacket.

3. The device of claim 1, wherein the magnetic member comprises:
a magnet; and
an electrically conductive plating adhered to the magnet.

4. The device of claim 1, wherein the magnetic member comprises:
a magnet; and
an electrically conductive sleeve in which the magnet is positioned.

5. The device of claim 4, wherein the magnet is statically positioned within the sleeve.

6. The device of claim 5, wherein the magnet engages the sleeve via an interference fit, magnetic attraction or an adhesive.

7. The device of claim 4, wherein:
the sleeve comprises a flange; and
the sleeve is translationally moveable between a first position in which the flange does not engage the jacket and a second position in which the flange does engage the jacket.

8. The device of claim 1, wherein the jacket comprises at least one guide member with which the magnetic member is slideably engaged.

9. The device of claim 8, wherein:
the magnetic member comprises a flange; and
the magnetic member is translationally moveable between a first position in which the flange does not engage the guide member and a second position in which the flange does engage the guide member.

10. The device of claim 1, wherein the jacket is soldered, clamped or fastened to the circuit board.

11. The device of claim 1, further comprising:
a second electrical contact comprising at least a first portion that is ferromagnetic;
wherein the second electrical contact engages the magnetic member so as to provide electrical continuity between the second electrical contact and the magnetic member, and the first portion of the second electrical contact is magnetically attracted to the magnetic member.

12. A device, comprising:
a circuit board; and
a first electrical contact comprising:
a magnet; and
an electrically conductive sleeve in which the magnet is positioned;
wherein a first portion of the sleeve is attached to the circuit board so as to provide electrical continuity between the sleeve and a conductive portion of the circuit board.

13. The device of claim 12, wherein the magnet is statically positioned within the sleeve.

14. The device of claim 12, wherein the sleeve is soldered to the circuit board.

15. The device of claim 12, further comprising:
a second electrical contact comprising at least a first portion that is ferromagnetic;
wherein the second electrical contact engages the sleeve so as to provide electrical continuity between the second electrical contact and the sleeve, and the first portion of the second electrical contact is magnetically attracted to the magnet.

16. A method of assembling a contact onto a circuit board, comprising:

fitting a magnet into the sleeve to form the magnetic assembly;

slideably fitting the sleeve into a jacket; and attaching the jacket to the circuit board.

17. The method of claim 16, wherein fitting the magnet into the sleeve comprises interference fitting the magnet within the sleeve.

18. The method of claim 16, wherein fitting the magnet into the sleeve comprises attaching the magnet to the sleeve with an adhesive.

19. The method of claim 16, wherein attaching the jacket to the circuit board comprises soldering the jacket to the circuit board.

20. The method of claim 16, wherein attaching the jacket to the circuit board comprises attaching the jacket to the circuit board with a clamp or fastener.

* * * * *